US008261676B2

(12) United States Patent
VanNimwegen et al.

(10) Patent No.: US 8,261,676 B2
(45) Date of Patent: Sep. 11, 2012

(54) TABLE

(75) Inventors: Ed VanNimwegen, North Ogden, UT (US); Donald Waite, North Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 268 days.

(21) Appl. No.: 12/110,163

(22) Filed: Apr. 25, 2008

(65) Prior Publication Data

US 2008/0264307 A1 Oct. 30, 2008

Related U.S. Application Data

(60) Provisional application No. 60/914,649, filed on Apr. 27, 2007.

(51) Int. Cl.
*A47B 3/00* (2006.01)

(52) U.S. Cl. ..... 108/125; 108/132; 108/155

(58) Field of Classification Search ..... 108/901, 108/125, 126, 129, 132, 153.1, 155; 248/166, 248/439, 188.6
See application file for complete search history.

(56) References Cited

U.S. PATENT DOCUMENTS

| | | | | |
|---|---|---|---|---|
| 1,165,991 | A | | 12/1915 | Maggs |
| 2,059,255 | A | | 11/1936 | Lassiat |
| 2,689,158 | A | | 9/1954 | Mahr |
| 3,357,729 | A | | 12/1967 | Krueger |
| 3,635,432 | A | | 1/1972 | Hollander |
| 3,718,306 | A | | 2/1973 | Murray |
| 3,999,490 | A | | 12/1976 | Rocker et al. |
| 4,503,780 | A | | 3/1985 | Apissomian |
| 4,606,170 | A | | 8/1986 | Mendenhall |
| 4,727,816 | A | | 3/1988 | Virtue |
| 4,759,296 | A | | 7/1988 | Simpson |
| 4,924,782 | A | | 5/1990 | Nichoalds |
| 5,014,628 | A | | 5/1991 | Roberts |
| 5,050,583 | A | | 9/1991 | Chapek et al. |
| 5,271,338 | A | | 12/1993 | Bonham |
| 5,311,825 | A | * | 5/1994 | Bonham ..... 108/27 |
| 5,348,384 | A | | 9/1994 | Hull et al. |
| 5,362,063 | A | | 11/1994 | Cummings |

(Continued)

FOREIGN PATENT DOCUMENTS

CA 2450012 5/2000

(Continued)

OTHER PUBLICATIONS

International Search Report and Written Opinion from International Application No. PCT/US2008/061693, dated Aug. 18, 2008, 12 pages.

(Continued)

*Primary Examiner* — Darnell Jayne
*Assistant Examiner* — Daniel Rohrhoff
(74) *Attorney, Agent, or Firm* — Maschoff Gilmore & Israelsen

(57) ABSTRACT

A table may include a table top and one or more leg assemblies. The table top may include a downwardly extending lip. The table may also include a frame, and the lip may include one or more receiving portions sized and configured to receive a portion of the frame. The receiving portions may also be sized and configured to receive a portion of a leg assembly. The table top may be constructed from molded plastic, such as blow-molded plastic, and the receiving portions may be integrally formed in the table top during the molding process.

23 Claims, 8 Drawing Sheets

U.S. PATENT DOCUMENTS

| | | | | |
|---|---|---|---|---|
| 5,440,857 | A | 8/1995 | Shanok et al. | |
| 5,496,609 | A | 3/1996 | Michelstein | |
| 5,570,484 | A | 11/1996 | Ogle | |
| 5,623,882 | A | 4/1997 | Price | |
| 5,636,578 | A | 6/1997 | Rizzi | |
| 5,678,380 | A | 10/1997 | Azzar | |
| 5,678,491 | A | 10/1997 | Price et al. | |
| 5,694,865 | A | 12/1997 | Raab | |
| 5,722,746 | A | 3/1998 | Hull et al. | |
| 5,732,637 | A | 3/1998 | Raab | |
| 5,809,901 | A | 9/1998 | Gutzmer | |
| 5,868,081 | A * | 2/1999 | Raab | 108/161 |
| 5,921,623 | A | 7/1999 | Nye et al. | |
| 5,947,037 | A | 9/1999 | Hornberger et al. | |
| D414,626 | S | 10/1999 | Collins et al. | |
| 5,983,807 | A | 11/1999 | Tarnay et al. | |
| 6,058,853 | A | 5/2000 | Pinch | |
| 6,058,854 | A * | 5/2000 | Tarnay et al. | 108/161 |
| 6,112,674 | A | 9/2000 | Stanford | |
| 6,214,436 | B1 | 4/2001 | Catta et al. | |
| 6,378,831 | B1 | 4/2002 | Copeland, Jr. | |
| D468,135 | S | 1/2003 | Ashby et al. | |
| 6,520,094 | B2 | 2/2003 | Wen | |
| 6,615,743 | B2 | 9/2003 | Nien | |
| 6,622,644 | B2 | 9/2003 | Buono | |
| 6,694,897 | B2 * | 2/2004 | Lou-Hao | 108/132 |
| D487,205 | S | 3/2004 | Mower et al. | |
| D489,557 | S | 5/2004 | Strong et al. | |
| 6,732,663 | B2 | 5/2004 | Tsai | |
| D499,283 | S | 12/2004 | Winter et al. | |
| 6,837,171 | B1 | 1/2005 | Clark | |
| 6,877,441 | B2 | 4/2005 | Zheng | |
| 6,915,748 | B2 | 7/2005 | Stanford | |
| D509,386 | S | 9/2005 | Haney | |
| 7,069,865 | B2 | 7/2006 | Strong et al. | |
| 7,096,799 | B2 | 8/2006 | Strong et al. | |
| 7,111,563 | B2 | 9/2006 | Strong | |
| 7,299,754 | B2 | 11/2007 | Stanford et al. | |
| 7,461,601 | B2 * | 12/2008 | Jin et al. | 108/132 |
| 7,475,643 | B2 | 1/2009 | Haney et al. | |
| 7,707,947 | B2 | 5/2010 | Winter et al. | |
| D640,487 | S | 6/2011 | Bennett | |
| 8,033,228 | B2 | 10/2011 | Haney et al. | |
| 8,042,475 | B2 | 10/2011 | Larcom et al. | |
| 2003/0005864 | A1 | 1/2003 | Wen | |
| 2003/0106474 | A1 | 6/2003 | Buono | |
| 2003/0177962 | A1 | 9/2003 | Stanford | |
| 2003/0213416 | A1 * | 11/2003 | Strong et al. | 108/129 |
| 2003/0233967 | A1 | 12/2003 | Lin | |
| 2004/0031422 | A1 | 2/2004 | Wong | |
| 2005/0160950 | A1 * | 7/2005 | Haney et al. | 108/129 |
| 2005/0241551 | A1 * | 11/2005 | Neunzert et al. | 108/132 |
| 2005/0274304 | A1 * | 12/2005 | Strong | 108/159 |
| 2005/0279260 | A1 | 12/2005 | Stanford | |
| 2006/0000394 | A1 | 1/2006 | Stanford | |
| 2006/0236902 | A1 * | 10/2006 | Haney et al. | 108/57.16 |
| 2008/0026881 | A1 | 1/2008 | Stanford et al. | |

FOREIGN PATENT DOCUMENTS

| | | |
|---|---|---|
| JP | 7-158263 | 6/1995 |
| JP | 2001-38796 | 2/2001 |
| WO | WO 2008026910 A2 * | 3/2008 |

OTHER PUBLICATIONS

International Search Report and Written Opinion from International Application No. PCT/US2008/061693, dated Aug. 20, 2008, 12 pages.

Notice of Allowance dated Sep. 18, 2008 cited in related U.S. Appl. No. 11/051,933.

Office Action dated Apr. 2, 2008 cited in related U.S. Appl. No. 11/051,933.

Office Action dated Aug. 2, 2007 from U.S. Appl. No. 11/051,933.

Office Action dated Nov. 9, 2006 from U.S. Appl. No. 10/409,273.

Office Action dated Nov. 2, 2009 from U.S. Appl. No. 11/373,582.

Office Action dated Oct. 7, 2008 from U.S. Appl. No. 11/373,582.

U.S. Appl. No. 10/409,273, filed Apr. 2003, Strong.

U.S. Appl. No. 60/371,486, filed Apr. 2002, Strong.

U.S. Appl. No. 60/541,639, filed Feb. 2004, Haney.

U.S. Appl. No. 60/660,061, filed Mar. 2005, Haney.

Office Action from related U.S. Appl. No. 12/351,827 dated Apr. 2, 2010.

U.S. Appl. No. 29/390,471, filed Apr. 25, 2011, Winter et al.

U.S. Appl. No. 29/391,721, filed May 12, 2011, Bennett.

U.S. Appl. No. 29/403,327, filed Oct. 4, 2011, Winter et al.

U.S. Appl. No. 13/270,141, filed Oct. 10, 2011, Haney et al.

* cited by examiner

TABLE

CROSS-REFERENCE TO RELATED APPLICATIONS

This application claims priority to, and the benefit of, U.S. provisional patent application Ser. No. 60/914,649, filed Apr. 27, 2007 and entitled TABLE, which is incorporated by reference in its entirety.

BACKGROUND OF THE INVENTION

1. Field of the Invention

The present invention generally relates to furniture and, in particular, to tables.

2. Description of Related Art

Many different types of tables are well known and used for a variety of different purposes. For example, many conventional tables may include legs that are pivotally attached to the table top and the legs may be movable between a use position in which the legs extend outwardly from the table top and a storage position in which the legs are folded against the table top. Large, portable tables with large, generally rectangular table tops and folding legs are often referred to as "banquet tables." Conventional banquet tables typically have a length between about six and eight feet and a width between about two and three feet.

Conventional banquet tables are often used in a variety of locations such as assembly halls, banquet halls, convention centers, hotels, schools, churches and other locations where large groups of people meet. Because these types of tables are generally portable, the tables may be positioned in an assortment of different configurations and used in a variety of settings. When the banquet tables are no longer needed, the tables can be moved or stored.

Banquet tables are often used by various organizations and groups because they allow effective and efficient use of space. For example, banquet tables may be used in large multipurpose areas such as school gymnasiums, meeting halls and hotel conference rooms to allow groups of people to meet. After the meetings are completed, the tables can be folded into the storage position and stowed in a relatively small space. This allows the gymnasiums, meeting halls and conference rooms to be used for other purposes. Thus, banquet tables allow groups and organizations to efficiently use a particular space.

Conventional tables may also have round table tops and these known round tables often have a diameter between about four and six feet. Know round tables may have also legs that are foldable between a use position and a storage position, and round tables may also be used in a variety of locations.

The legs of many conventional tables are attached directly to the table top by a number of mechanical fasteners such as screws or bolts. Disadvantageously, the mechanical fasteners may create a number of holes in the table top and these holes may decrease the structural integrity of the table top and/or create undesirable stress concentrations in the table top. The holes may also create weakness or failure points that may allow the table to give way and collapse.

In addition, the legs of conventional tables may be connected to a frame and the frame may be connected to the table top. Because the legs may be connected to the frame, the positioning of the frame may limit the positioning of the legs relative to the table top. This may create a table that is unstable or unsteady, especially if a load or force is applied proximate an outer edge or perimeter of the table top.

It is also known to construct tables with table tops constructed from materials, such as plastic, in an attempt to decrease the weight of the tables. Many of these lighter-weight tables, however, lack the strength and sturdiness of the heavier-weight tables. Thus, many lighter-weight tables require complex support mechanisms and one or more support braces to increase the strength and sturdiness of the table, which may undesirably increase the weight and complexity of the tables. Additionally, the edges of many conventional tables are not adequately supported and that may allow the edges to be more easily damaged, especially if the table top is constructed from light-weight plastic.

BRIEF SUMMARY OF EMBODIMENTS OF THE INVENTION

A need therefore exists for a structure that eliminates or diminishes the disadvantages and problems described above.

One aspect is a table that may include a table top constructed from light-weight materials such as plastic. In particular, the table top may be constructed from blow-molded plastic. Significantly, if the table top is constructed from blow-molded plastic, it may be easily formed into a desired configuration, shape, size and design depending, for example, upon the intended use and/or configuration of the table. In addition, the blow-molded plastic table top may include a hollow interior portion that may help provide a lightweight table top. It will be appreciated that the table top could be constructed from other suitable materials and processes, such as injection molding, extrusion molding and the like.

Another aspect is a table top that may include a downwardly extending lip. The lip is preferably disposed at least proximate an outer edge or perimeter of the table top, but the lip could be spaced inwardly from the outer edge or perimeter, if desired.

Still another aspect is a table top that may include a lip that varies in thickness or width to allow the frame and/or legs to be positioned closer to the outer edge or perimeter of the table top. For example, the lip may include a thinner portion disposed between a first thicker portion and a second thicker portion. In particular, the thinner portion of the lip may be adjacent to and disposed between the first and second thicker portions of the lip. Desirably, the thinner portion of the lip may help facilitate placement of other components of the table. For instance, one or more portions of the frame and/or the leg assembly may contact, abut, engage and/or be disposed at least proximate the thinner portion of the lip. In greater detail, the frame may include one or more rails and an end of a rail may contact, abut, engage and/or be disposed at least proximate the thinner portion. The leg assembly may also include a cross member that may pivotally or otherwise movably connect one or more legs to the frame and/or the table top, and an end of the cross member may contact, abut, engage and/or be disposed at least proximate the thinner portion. The thinner portion of the lip may have an inner surface and an outer surface, and the outer surface may have a generally curvilinear shape, such as generally convex shape. Desirably, the outer surface forms part of the table top and/or lip.

Yet another aspect is a table top that may include a lip with one or more receiving portions that are sized and configured to receive components such as a portion of the frame and/or legs. For example, a portion of the frame and/or legs may be at least partially disposed in the receiving portions, which may allow the frame and/or legs to be positioned in a desired location.

A further aspect is a table top that may include a downwardly extending lip with a thinner portion disposed between a first thicker portion and a second thicker portion. The thicker portions of the lip may have a thickness that is at least about two, three, four or five times the thickness of the thinner portion of the lip. Thus, for example, the thinner portion of the lip may have a thickness about twenty to thirty percent of the thickness of the thicker portions of the lip. In particular, the thicker portions of the lip may have a thickness that is generally equal to or greater than about 0.9 inches, about 1 inch, about 1.1 inches, about 1.2 inches, about 1.3 inches and/or other suitable thicknesses, while the thinner portion of the lip may have a thickness that is generally less than or equal to about 0.5 inches, about 0.4 inches, about 0.3 inches, about 0.25 inches and/or other suitable thicknesses. The thinner and thicker portions of the lip, however, may have other suitable thicknesses depending, for example, upon the particular configuration of the lip and/or the intended use of the table.

Another further aspect is a table that may include a frame and a table top with a downwardly extending lip including a first thinner portion disposed between a first pair of thicker portions and a second thinner portion disposed between a second pair of thicker portions. The frame may include a rail with a first end and a second end. The first end of the rail may contact, abut, engage and/or be disposed proximate to the first thinner portion of the lip and the second end of the rail may contact, abut, engage and/or be disposed proximate to the second thinner portion of the lip. Desirably, the first and second thinner portions may allow a longer rail to be used, which may help provide greater stability for the table. If desired, the first and second thinner portions may include receiving portions that are sized and configured to receive at least a portion of the frame.

Yet another further aspect is a table that may include a frame and a table top with a downwardly extending lip including a first thinner portion disposed between a first pair of thicker portions, a second thinner portion disposed between a second pair of thicker portions, a third thinner portion disposed between a third pair of thicker portions and a fourth thinner portion disposed between a fourth pair of thicker portions. The frame may include a first rail and a second rail. A first end of the first rail may contact, abut, engage and/or be disposed proximate to the first thinner portion of the lip, and a second end of the first rail may contact, abut, engage and/or be disposed proximate to the second thinner portion of the lip. In addition, a first end of the second rail may contact, abut, engage and/or be disposed proximate to the third thinner portion of the lip, and a second end of the second rail may contact, abut, engage and/or be disposed proximate to the fourth thinner portion of the lip. Desirably, the first, second, third and fourth thinner portions may allow the first and second rails to be spaced apart at a greater distance, which may help provide greater stability for the table. The first, second, third and fourth thinner portions may also allow the first and second rails to have a greater length.

A still further aspect is a table that may include a leg assembly and a table top with a downwardly extending lip including a first thinner portion disposed between a first pair of thicker portions and a second thinner portion disposed between a second pair of thicker portions. The leg assembly may include a cross member that may pivotally connect one or more legs to a frame and/or the table top. A first end of the cross member may contact, abut, engage and/or be disposed proximate to the first thinner portion of the lip, and a second end of the cross member may contact, abut, engage and/or be disposed proximate to the second thinner portion of the lip. Desirably, the first and second thinner portions may allow a longer cross member to be used, which may help provide greater stability for the table. If desired, the first and second thinner portions may include a receiving portions that are sized and configured to receive at least a portion of the cross member.

Another aspect is a table top that may include one or more features that are integrally formed in the table top as part of a unitary, one-piece structure. Advantageously, this may reduce the number of steps required in the manufacturing process, which may reduce the overall cost of the table. For instance, the features may be integrally formed in the table top during a molding process, such as a blow molding process. These features that may be integrally formed in the table top during the manufacturing process as part of a unitary, one-piece structure may include the thicker and thinner portions of the lip, the receiving portions of the lip and the like.

Still another aspect is a mold that may be used to form a blow-molded plastic table top. The mold may be sized and configured to construct a table top that may include a downwardly extending lip including thinner portions disposed thicker portions. The mold may include a plurality of pieces, which may include a parting line. A portion of the parting line at the thinner portion of the lip may be offset towards the bottom of the thinner portions.

Yet another aspect is a table top that may include a lip with receiving portions that are formed at least proximate an outer edge or perimeter of the table top. Advantageously, the receiving portions may allow the frame and/or legs to be disposed at least proximate the outer edge or perimeter of the table top. Significantly, this may allow a table to be constructed that is stronger, sturdier, steadier, more stable, better balanced and the like.

A further aspect is a table that may include a blow-molded plastic table top with a generally downwardly extending lip and a hollow interior portion that is integrally formed in the table top during the blow-molding process. The lip may include a first receiving portion, a first thinner portion disposed between a first pair of thicker portions, the first thinner portion including an at least substantially solid compression portion that forms at least a part of the first receiving portion, a second receiving portion and a second thinner portion disposed between a second pair of thicker portions, the second thinner portion including an at least substantially solid compression portion that forms at least a part of the second receiving portion. A first rail may be connected to the table top, the first rail may include a first end and a second end, the first end of the first rail being disposed in the first receiving portion, the second end of the first rail being disposed in the second receiving portion. The table may also include a leg assembly movable between an extended position and a collapsed position relative to the table top.

Still another further aspect is a table that may include a blow-molded plastic table top with a generally downwardly extending lip and a hollow interior portion integrally formed in the table top during the blow-molding process. The lip may include a first thinner portion disposed between a first pair of thicker portions, the first thinner portion including a first receiving portion, each of the first pair of thicker portions having a thickness that is at least three times the thickness of the first thinner portion; and a second thinner portion disposed between a second pair of thicker portions, the second thinner portion including a second receiving portion, each of the second pair of thicker portions having a thickness that is at least three times the thickness of the second thinner portion. A first rail may be connected to the table top, the first rail including a first end and a second end, the first end of the first rail being disposed in the first receiving portion, the second end of the first rail being disposed in the second receiving portion. In addition, a leg assembly may be movable between an extended position and a collapsed position relative to the table top.

Yet another further aspect is a table that may include a blow-molded plastic table top with a generally downwardly extending lip and a hollow interior portion integrally formed in the table top during the blow-molding process. The lip may include a first receiving portion; a first thinner portion disposed between a first pair of thicker portions, the first thinner portion including an at least substantially solid compression portion that forms at least a part of the first receiving portion; a second receiving portion; and a second thinner portion disposed between a second pair of thicker portions, the second thinner portion including an at least substantially solid compression portion that forms at least a part of the second receiving portion. The table may also include a frame connected to the table top and a leg assembly.

Still yet another further aspect is a table that may include a blow-molded plastic table top including a generally downwardly extending lip and a hollow interior portion integrally formed in the table top during the blow-molding process. The lip may include a a first thinner portion disposed between a first pair of thicker portions, the first thinner portion including a first receiving portion, each of the first pair of thicker portions having a thickness that is at least three times the thickness of the first thinner portion; and a second thinner portion disposed between a second pair of thicker portions, the second thinner portion including a second receiving portion, each of the second pair of thicker portions having a thickness that is at least three times the thickness of the second thinner portion. The table may also include a frame that is connected to the table top. In addition, the table may include a leg assembly including a cross member movably connected to the frame, the cross member including a first end and a second end, the first end of the cross member being disposed in the first receiving portion, the second end of the cross member being disposed in the second receiving portion; and at least one leg connected to the cross member.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards tables. The principles of the present invention, however, are not limited to tables. It will be understood that, in light of the present disclosure, the table disclosed herein can be successfully used in connection with other types of furniture and/or structures.

Additionally, to assist in the description of the table, words such as top, bottom, front, rear, right and left may be used to describe the accompanying figures, which are not necessarily drawn to scale. It will be appreciated, however, that the table can be located in a variety of desired positions and/or orientations. A detailed description of the table now follows.

Figure 1:
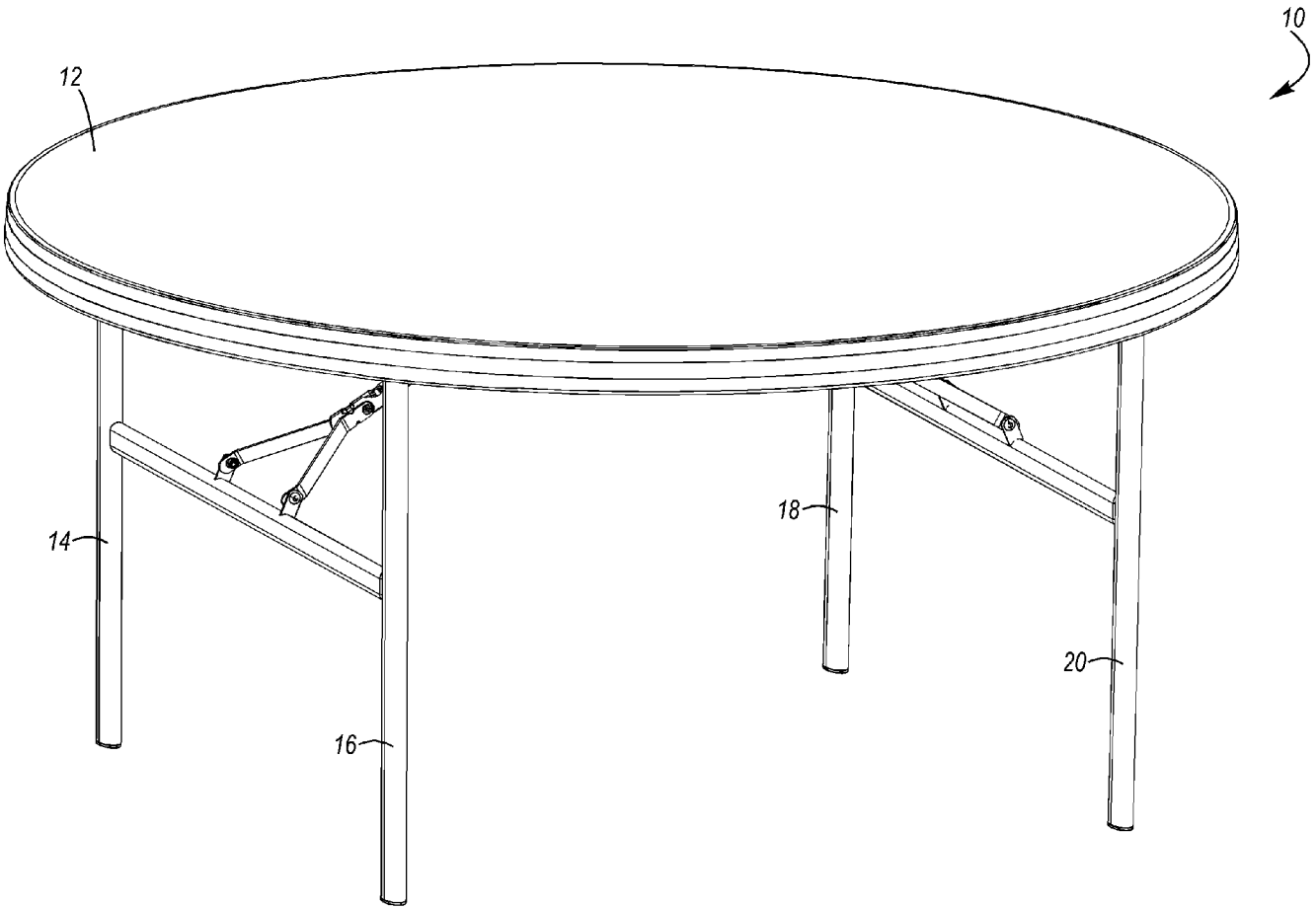
FIG. 1 is an upper perspective view of an exemplary table.

As shown in FIG. 1, a table 10 may include a table top 12 and one or more legs or support pedestals 14, 16, 18, 20 that may be sized and configured to support the table top. The legs 14, 16, 18, 20 are preferably movable between an extended or use position and a collapsed or storage position. Advantageously, when the legs 14, 16, 18, 20 are in the use position, the table 10 may be used to support a wide variety of objects and the table may be used for a variety of different purposes. A person of ordinary skill in the art may appreciate that the legs 14, 16, 18, 20 may have a variety of suitable shapes, sizes, configurations and arrangements depending, for example, upon the intended use of the table 10.

Figure 2:
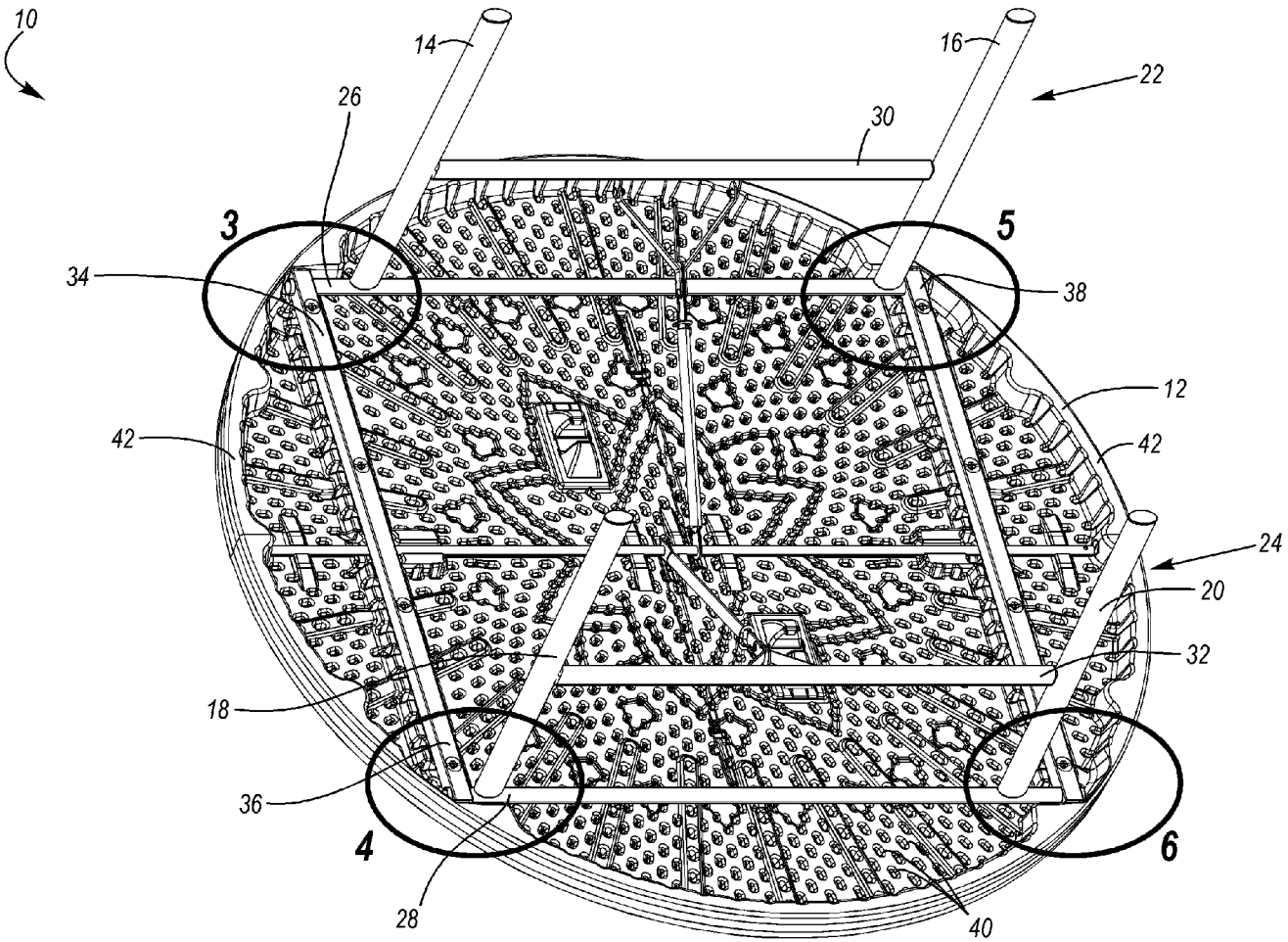
FIG. 2 is a lower perspective view of the table shown in FIG. 1, illustrating an exemplary table top, an exemplary frame and exemplary leg assemblies.

As shown in FIG. 2, the table 10 may include one or more leg assemblies 22, 24 and the leg assemblies may include, for example, a pair of legs and a cross member interconnecting the legs. For instance, as shown in the accompanying figures, the leg assembly 22 may include the legs 14, 16 and a cross member 26 may connect the legs 14, 16. Similarly, the leg assembly 24 may include the legs 18, 20 and a cross member 28 may connect to the legs 18, 20. The leg assemblies 22, 24 may also include other components, such as cross members 30, 32 that may be used to connect the legs. Desirably, with one or more cross members interconnecting the legs, the legs may be moved collectively between the storage and use positions. The legs 14, 16, 18, 20, however, need not be interconnected and may be sized and configured to be independently moved between the storage and use positions. The legs 14, 16, 18, 20, however, do not have to be movable between the storage and use positions, and the legs could remain in a fixed position if desired. A person of ordinary skill in the art will appreciate that the leg assemblies 22, 24 could have a variety of suitable shapes, sizes, configurations and arrangements depending, for example, upon the intended use of the table 10. In addition, a person of ordinary skill in the art will appreciate that the leg assemblies 22, 24 could include any suitable number of legs and may consist of a single leg, if desired.

The table 10 may also include a frame 34 and the frame may be connected to the table top 12. In addition, the leg assemblies 22, 24 may be connected to the frame 34, if desired. In greater detail, the frame 34 may include one or more support members, such as rails 36, 38. The rails 36, 38 are preferably connected to the table top 12 and the rails may be sized and configured to help support the table top. Additionally, the leg assemblies 22, 24 may be pivotally or movably connected to the rails 36, 38 of the frame 34, which may allow the leg assemblies to move between the extended or use positions and the collapsed or storage positions relative to the table top 12. Specifically, the cross members 26, 28 and/or other portions of the leg assemblies 22, 24 may be pivotally or movably connected to the rails 36, 38. It will be understood that the frame 34 may have a variety of suitable shapes, sizes, configurations and arrangements depending, for example, upon the size and shape of the table top 12 and/or the intended use of the table 10.

The table top 12 is preferably constructed from lightweight materials, such as plastic. The plastic table top 12 may be constructed using a blow-molded process, but other suitable processes could also be used such as injection molded, extruded and the like. When the table top 12 is constructed from blow-molded plastic, it may be easily formed into a desired configuration, shape, size and design depending, for example, upon the intended use and/or configuration of the table 10. The blow-molded plastic table top 12 may be also generally weather resistant and temperature insensitive, which may allow the table 10 to be used in a wide variety of locations and environments. In addition, the blow-molded plastic table top 12 may be durable, long-lasting and it may not corrode, rust or otherwise deteriorate over time. Further, because the blow-molded plastic table top 12 may be relatively strong, it may be used to support a relatively large amount of weight. Significantly, the blow-molded plastic table top 12 may form a structural member of the table 10.

Advantageously, the blow-molded plastic table top 12 may be relatively strong because it may include two or more opposing walls or surfaces that are separated by a given distance. In addition, because the table top 12 may include a hollow interior portion that is formed during the blow-molding process, a lightweight table top may be constructed. Thus, the blow-molded plastic table top 12 can be both lightweight and strong. The blow-molded plastic table top 12 may also be lightweight and strong even if the interior is filled with materials such as foam. As discussed above, the table top 12 may be constructed from other materials and/or processes such as rotary molding, injection molding and the like.

As shown in FIGS. 2-6, the table top 12 may include one or more depressions, "tack-offs" or "kiss-offs" 40. The depressions 40, which can extend from one surface towards another surface, may be sized and configured to increase the strength and/or rigidity of the table top 12. The depressions 40 may extend from one surface and contact or engage an opposing surface, but the depressions do not have to contact or engage another surface. If desired, the depressions 40 may be formed in the bottom surface of the table top 12 so that the depressions are generally not visible. The depressions 40, however, may be formed in the top surface and/or other suitable portions of the table top 12. For example, one or more depressions 40 may be formed in the top surface of the table top 12 and one or more depressions may be formed in the bottom surface of the table top, and these opposing depressions may be generally aligned. At least a portion of these opposing depressions may contact or engage each other, but the opposing depressions do not have to touch or engage.

The depressions 40 may be located in a predetermined pattern to increase the strength of the table top 12 and/or decrease the amount of plastic used to construct the table top. Advantageously, if the depressions 40 are placed near each other, then the table top 12 may be constructed with thinner outer surfaces or walls and the strength of the table top may be increased. Desirably, the locations of the depressions 40 need not vary significantly even when other features are integrally formed in the table top 12. Thus, for example, the depressions 40 may be positioned in close proximity and in the same general pattern even around features such as attachment points, edges and other features of the table top 12. In addition, one or more depressions 40 may be formed within the various features to maintain the generally consistent pattern of depressions. Significantly, the generally uniform pattern of depressions 40 may allow a table top 12 with homogeneous characteristics to be constructed. Of course, the depressions 40 could be positioned in other suitable locations, designs, patterns and the like.

Significantly, when the table top 12 is constructed with thinner outer surfaces or walls, this may decrease the amount of plastic required to construct the table top and thus save manufacturing costs and reduce the amount of resources required to construct the table top. The thin outer walls may also allow the table top 12 to be cooled more quickly during the manufacturing process, which may allow the table tops to be manufactured more quickly and efficiently. Additionally, because the table top 12 may be constructed from blow-molded plastic with thin outer walls, this may allow a table 10 with reduced weight to be constructed. Significantly, the reduced weight table 10 can be easily transported, which decreases shipping costs. Also, a consumer may appreciate the reduced weight because they can much more easily move and/or assemble the table 10.

As shown in FIG. 2, the table top 12 may include a downwardly extending lip 42. The lip 42 is preferably disposed at least proximate an outer edge or perimeter of the table top 12. For example, if the table 10 includes a round table top 12, then an outer surface of the lip 42 is preferably aligned with an outer surface of the table top. Thus, the outer surface of the lip 42 and the outer surface of the table top 12 are preferably aligned. All or a portion of the lip 42, however, could be spaced inwardly from the outer edge or perimeter of the table top 12.

The lip 42 may include a width or thickness that is preferably measured from the outer surface of the lip to an inner surface of the lip. The lip 42 preferably also has a generally constant width or thickness and the lip preferably is disposed about the entire outer perimeter of the table top 12. The lip 42, however, may extend about only a portion of the table top 12 and the lip does not have to have a generally constant width or thickness.

As shown in the accompanying figures, the inner surface of the lip 42 may include a number of serrations, notches, ribs, and/or struts that are sized and configured to increase the strength, rigidity and/or flexibility of the lip. Advantageously, the uneven inner surfaces of the lip 42 may increase the strength, rigidity and/or flexibility of the table top. It will be appreciated, however, that the lip 42 does not require the serrations, notches, ribs, and/or struts or uneven surfaces and that the table top 12 does not require any corners. It will also be appreciated that the outer surface of the lip 42 may include one or more serrations, notches, ribs, and/or struts or uneven surfaces, if desired.

As best seen in FIGS. 7-11, the lip 42 preferably has a generally constant width or thickness, even if the lip includes various serrations, notches, ribs, and/or struts or uneven surfaces. That is, the lip 42 preferably has a generally consistent overall width or thickness, including if the lip includes serrations, notches, ribs, and/or struts or uneven surfaces.

As shown in FIGS. 7-11, the lip 42 may include a thinner portion 44 and the thinner portion is preferably disposed between a first thicker portion 46 and a second thicker portion 48. In greater detail, the thinner portion 44 may be adjacent to and disposed between the thicker portions 46, 48. The thinner portion 44 of the lip 42 may have an inner surface 50 and an outer surface 52, and the outer surface may have a generally curvilinear shape, such as generally convex shape. The outer surface 52 of the thinner portion 44 of the lip 42 is preferably generally aligned with the outer edge or perimeter of the table top 12. The outer surface 52 of the thinner portion 44 of the lip 42, however, could have other suitable shapes, if desired.

The thicker portions 46, 48 of the lip 42 may have a thickness that is at least two, three, four, five or more times the thickness of the thinner portion 44 of the lip 42. Thus, the thinner portion 44 of the lip 42 may have a thickness that is about fifty percent, forty percent, thirty percent, twenty percent, ten percent or less of the thickness of the thicker portions 46, 48. For example, the thicker portions 46, 48 of the lip 42 may have a thickness that is generally equal to or greater than 0.9 inches, 1.0 inches, 1.1 inches, 1.2 inches, 1.3 inches, 1.4 inches, 1.5 inches and/or more; while the thinner portion 44 of the lip 42 may have a thickness that is generally equal to or less than about 0.5 inches, 0.4 inches, 0.3 inches, 0.25 inches and/or less. It will be appreciated that the thinner portion 44 and thicker portions 46, 48 of the lip 42 may have other suitable thicknesses depending, for example, upon the particular configuration of the lip.

Figure 3:
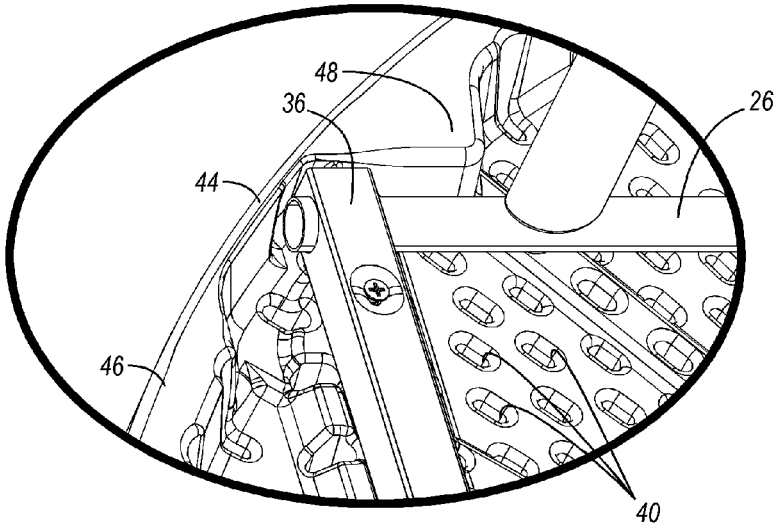
FIG. 3 is an enlarged view of a portion of the table shown in FIG. 2.
Figure 4:
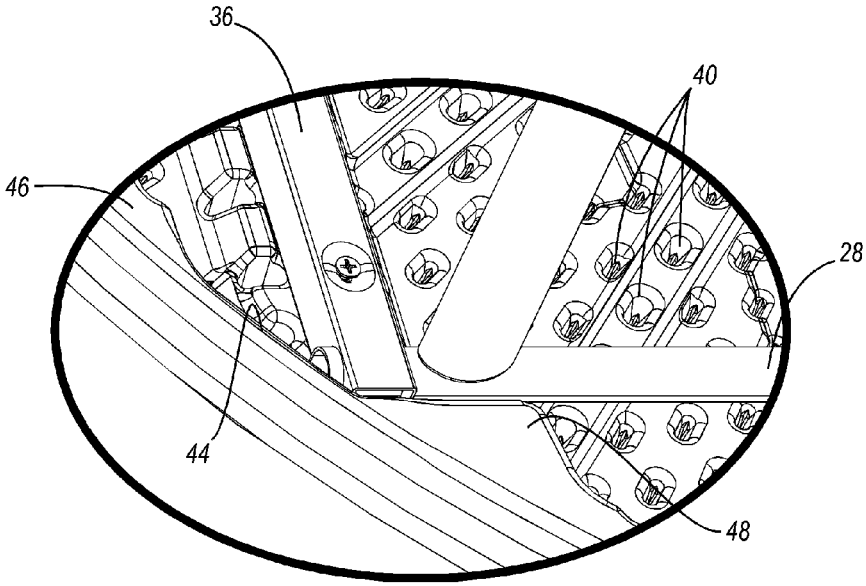
FIG. 4 is an enlarged view of another portion of the table shown in FIG. 2.
Figure 5:
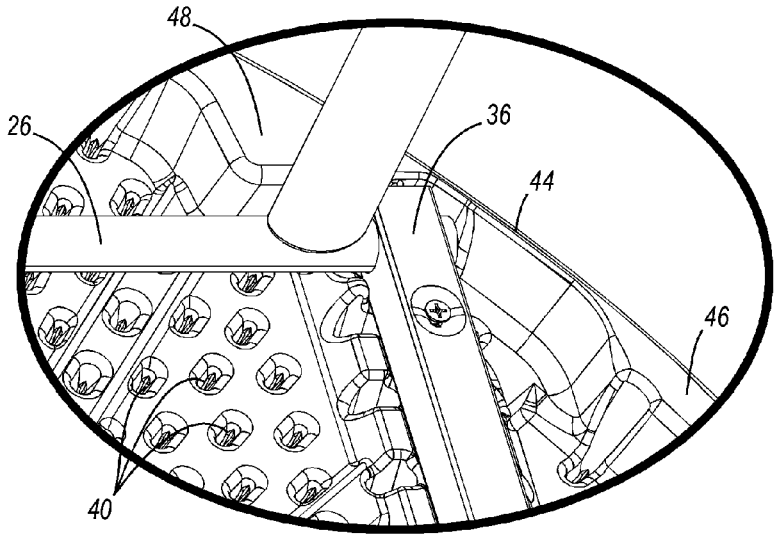
FIG. 5 is an enlarged view of yet another portion of the table shown in FIG. 2.
Figure 6:
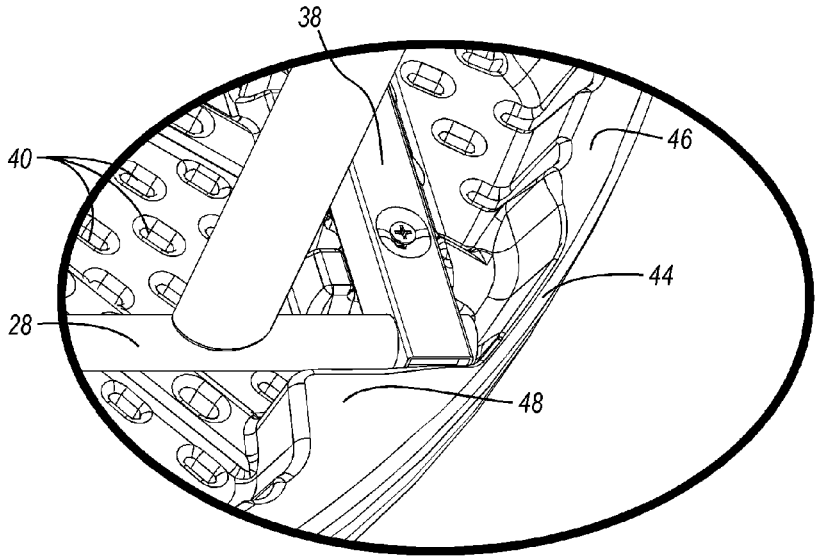
FIG. 6 is an enlarged view of still another portion of the table shown in FIG. 2.
Figure 7:
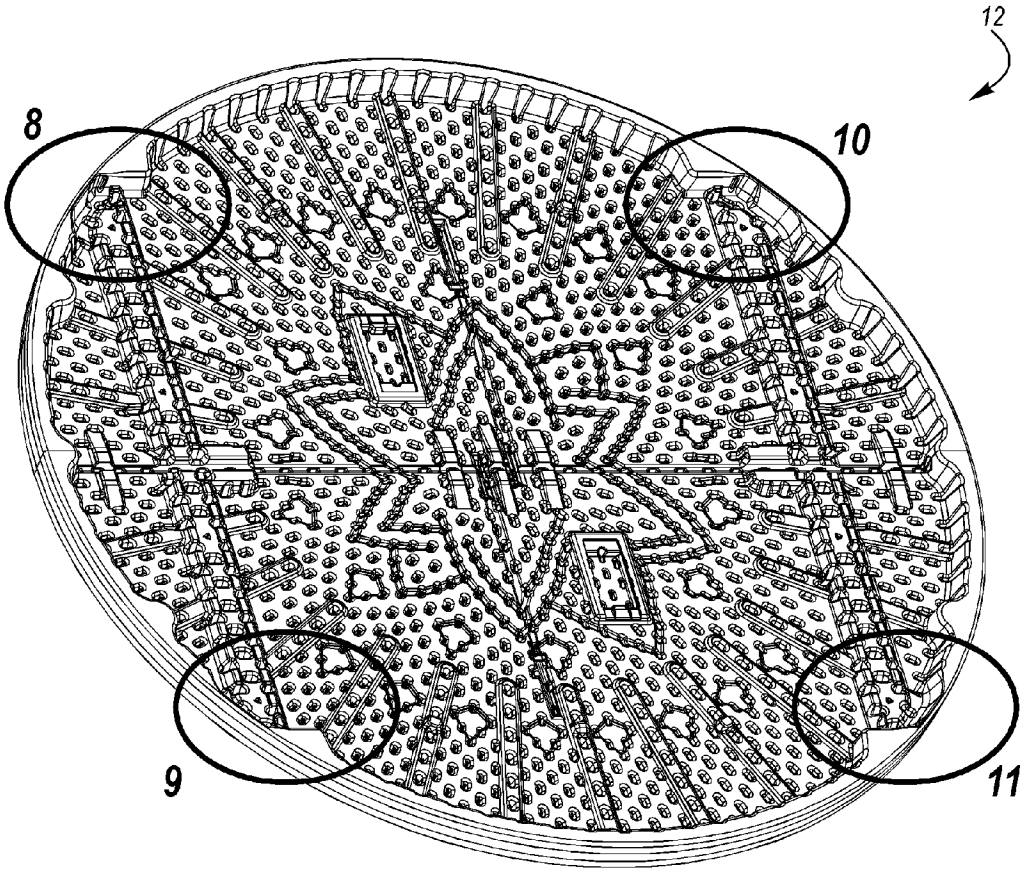
FIG. 7 is a lower perspective view of a portion the table shown in FIG. 2, illustrating the table top.

Desirably, the thinner portion 44 and/or thicker portions 46, 48 of the lip 42 may help facilitate placement of other components of the table 10. In particular, one or more portions of the frame 34 and/or a leg assembly 22, 24 may contact, abut, engage and/or be disposed at least proximate the thinner portion 44 of the lip 42. For example, as shown in FIGS. 2-3, an end of the rail 36 may contact, abut, engage and/or be disposed at least proximate the thinner portion 44; and an end of the cross member 26 may contact, abut, engage and/or be disposed at least proximate the thinner portion.

As shown in FIGS. 7-11, the lip 42 may include a plurality of thinner portions 44 adjacent to and/or disposed between a pair of thicker portions 46, 48. As shown in FIGS. 2-6, the ends of a rail 36, 38 may contact, abut, engage and/or be disposed at least proximate a pair of spaced apart thinner portions 44. In addition, as shown in FIGS. 2-6, the ends of a cross member 26, 28 may contact, abut, engage and/or be disposed at least proximate a pair of spaced apart thinner portions.

As shown in FIGS. 8-11, the lip 42, the thinner portions 44 and/or the thicker portions 46, 48 may include and/or form at least a portion of a receiving portion 54. The receiving portions 54 are preferably sized and configured to receive one or more portions of the frame 34 and/or a leg assembly 22, 24. For example, as shown in FIGS. 2-6, opposing ends of the side rails 36, 38 may be disposed in spaced apart receiving portions 54. In addition, as shown in FIGS. 2-6, the ends of a cross member 26, 28 may be disposed in a pair of spaced apart receiving portions 54.

Desirably, the thinner portions 44 may allow longer cross members 26, 28 and/or longer rails 36, 38 to be used, which may help provide greater stability and/or strength for the table 10 and table top 12. In addition, the thinner portions 44 may allow the legs 14, 16, 18, 20 and/or leg assemblies 22, 24 to be positioned closer to the outer perimeter or edge of the table top 12. For example, instead of the legs 14, 16, 18, 20 and/or leg assemblies 22, 24 being spaced apart from the outer edge or perimeter of the table top 12, the thinner portions 44 may allow the legs and/or leg assemblies to be positioned at least proximate the outer edge or perimeter of the table top. This may allow the legs 14, 16, 18, 20 and/or leg assemblies 22, 24 to be positioned directly below or spaced only slightly inwardly from the outer edge or perimeter of the table top 12. This may also allow the legs 14, 16, 18, 20 and/or leg assemblies 22, 24 to directly support the outer edge or perimeter of the table top 12. Significantly, if the legs 14, 16, 18, 20 and/or leg assemblies 22, 24 are positioned closer to the outer edge or perimeter of the table top 12, then the outer edge may be more securely supported and it may allow a table 10 that is more stable and sturdy to be constructed.

Figure 8:
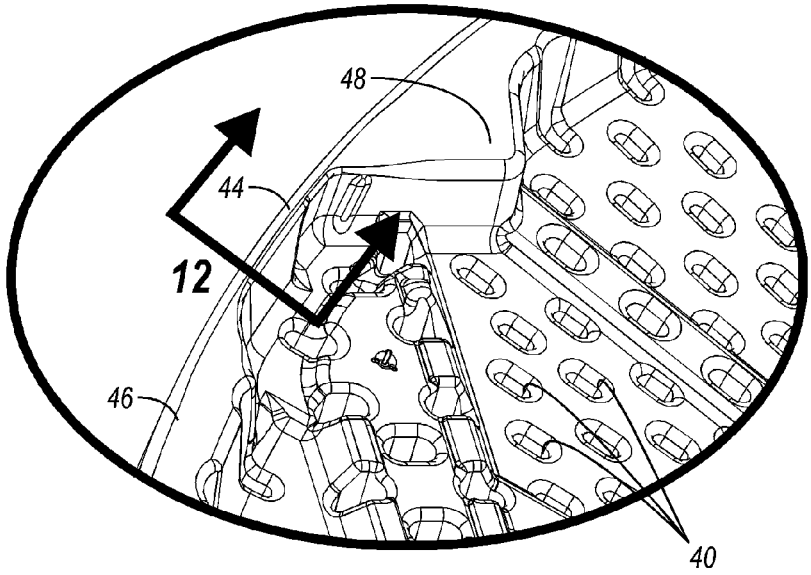
FIG. 8 is an enlarged view of a portion of the table top shown in FIG. 7.
Figure 9:
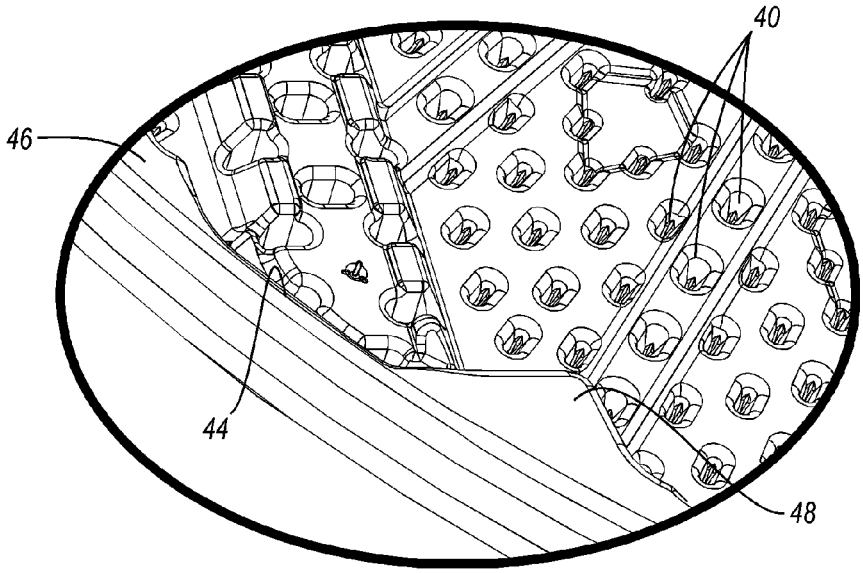
FIG. 9 is an enlarged view of another portion of the table top shown in FIG. 7.
Figure 10:
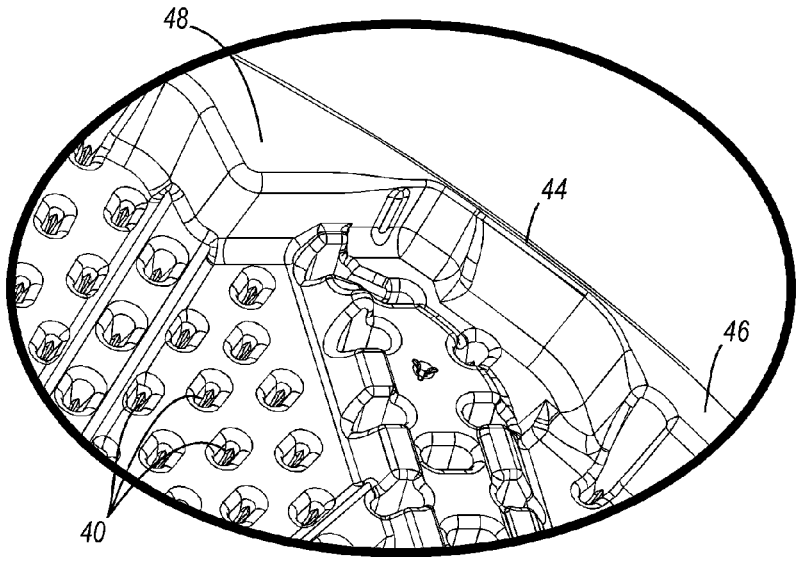
FIG. 10 is an enlarged view of yet another portion of the table top shown in FIG. 7.
Figure 11:
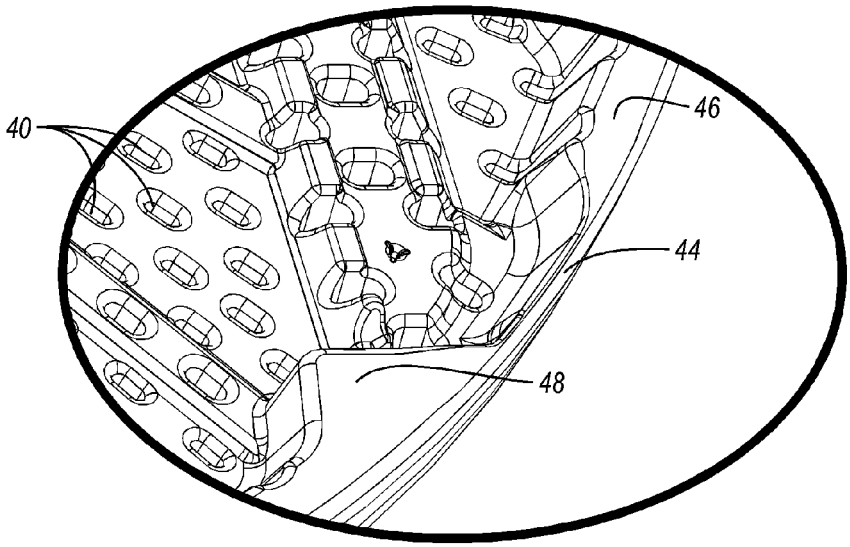
FIG. 11 is an enlarged view of still another portion of the table top shown in FIG. 7.
Figure 12:
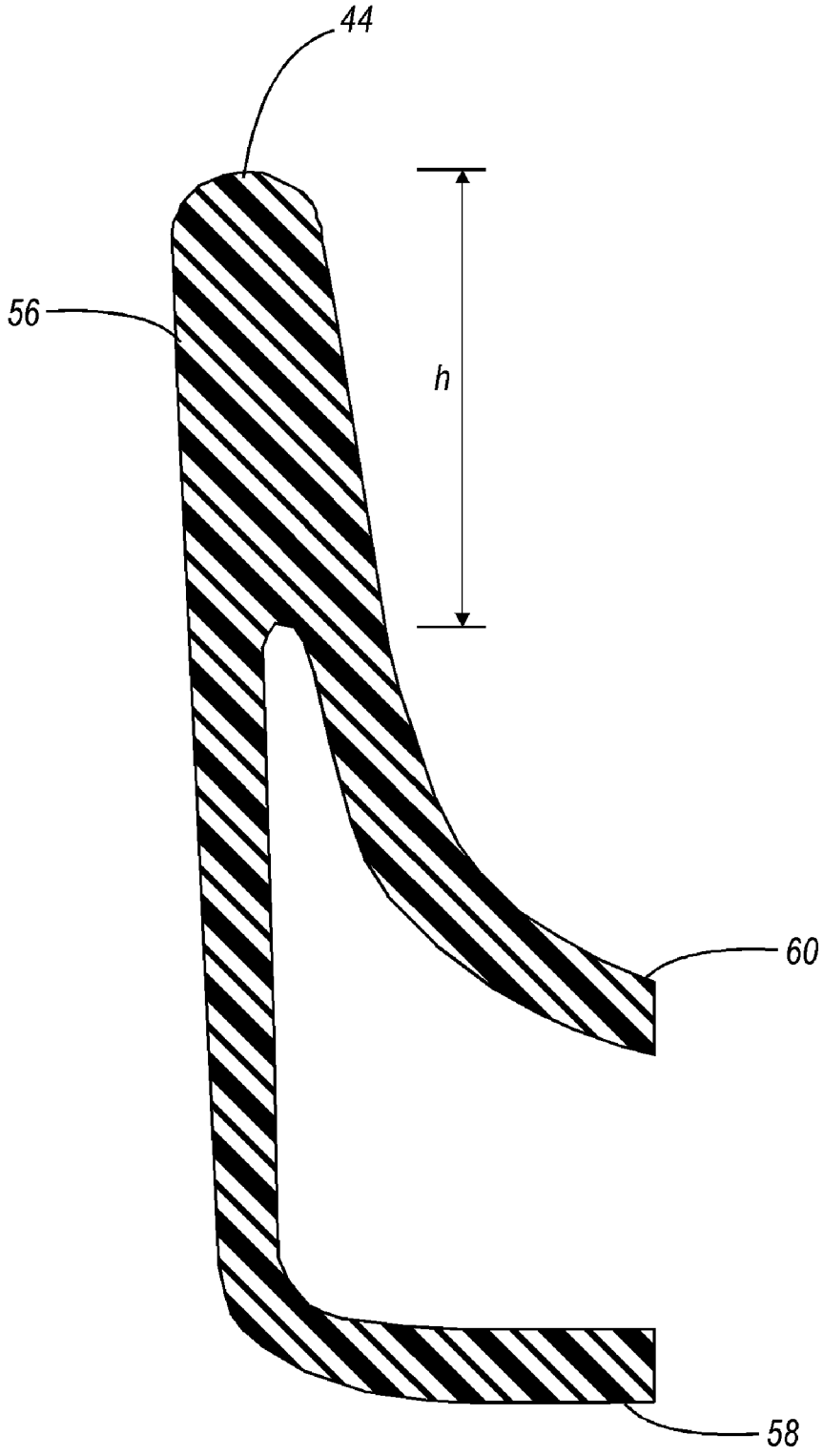
FIG. 12 is an enlarged view of exemplary outer edge or perimeter of a table top.

As shown in FIGS. 8 and 12, the lower edge of the thinner portion 44 may include a compression portion 56. The compression portion 56 and/or the lower edge of the thinner portion 44 are preferably formed by mating, contacting and/or engaging opposing surfaces of the table top 12. For example, as best seen in FIG. 12, the table top 12 may include opposing surfaces that form an upper surface 58 and a lower surface 60 of the table top 12. The opposing surfaces may also form inner and outer portions of the lip 42. In greater detail, if the table top 12 is constructed from blow-molded plastic, then the upper and lower surfaces 58, 60 may mate, contact and/or engage to form the compression portion 56 and/or the lower edge of the thinner portion 44 of the lip 42. Preferably, there is no gap or space between the upper and lower surfaces 58, 60 where they mate, contact and/or engage so that the compression portion 56 and/or the lower edge of the thinner portion 44 may have a thickness that is approximately equal to the thickness of the two surfaces combined. Advantageously, the compression portion 56 and/or the lower edge of the thinner portion 44 may be integrally formed with the table top 12 as part of a unitary, one-piece structure during the manufacturing process.

As shown in FIG. 12, the compression portion 56 and/or the lower edge of the thinner portion 44 may have at least a substantially solid construction. The at least substantially solid compression portion 56 and/or lower edge of the thinner portion 44 may have a height h that is at least about two times, at least about three times and/or at least about four times the individual or combined thicknesses of the lower surface 60 and the upper surface 58 of the table top 12. The height h of the at least substantially solid compression portion 56 and/or lower edge of the thinner portion 44 may also be larger or smaller, if desired.

This at least substantially solid construction may be formed during the blow-molding process, and as noted above, the compression portion 56 and/or the lower edge of the thinner portion 44 may be blow-molded as an integral part of the table top 12. In further detail, the mold may include a plurality of pieces, which may include a parting line. One or more portions of the parting line may be offset from the center of the table top's height. In particular, portions of the parting line may be offset towards and/or disposed at least proximate to a lower portion of the blow-molded plastic table top 12, for instance, proximate the thinner portions 44. Disposing the parting line in such locations may help form the compression portion 56 and/or the lower edge of the thinner portion 44 with an at least substantially solid construction. In particular, disposing the parting line in such locations may help the blow-molding process provide a compression molding effect that compresses a portion of the parison into the compression portion 56 and/or the lower edge of the thinner portion 44 to create the at least substantially solid construction.

Significantly, this at least substantially solid construction may help strengthen and/or reinforce the table and may allow the thinner portions 44 to be even thinner. This, in turn, may advantageously allow longer cross members 26, 28 and/or longer rails 36, 38 to be used, which may help provide greater stability and/or strength for the table 10 and table top 12

As mentioned above, the table top 12 may be constructed from blow-molded plastic. Advantageously, the blow-molding process may allow the opposing walls, the depressions 40, the lip 42, the thinner portions 44 of the lip, the thicker portions 46, 48 of the lip, the receiving portions 54, the compression portion 56 and/or other desired features to be quickly and easily formed in the table top 12. In addition, the blow-molded plastic table top 12 may be constructed as an integral, one-piece structure, which may help create a strong and rigid table top, but the table top could also be constructed from two or more pieces that are interconnected.

It will be understood that the table top 12 may also be constructed from other suitable materials and processes. In addition, the table top 12 may include other suitable features and structures, such as disclosed in U.S. patent application Ser. No. 11/838,844, which was filed on Aug. 14, 2007, entitled SPORTS SYSTEM; U.S. patent application Ser. No. 11/051,933, which was filed on Feb. 4, 2005, entitled EDGE AND CORNER FOR A STRUCTURE CONSTRUCTED FROM BLOW-MOLDED PLASTIC; U.S. patent application Ser. No. 11/373,582, which was filed on Mar. 9, 2006, entitled TABLE WITH EDGE SUPPORT STRUCTURES; and U.S. patent application Ser. No. 11/142,017, which was filed on Jun. 1, 2005, entitled TABLE. The disclosures of each of these applications are incorporated by reference in their entireties.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a blow-molded plastic table top including an upper surface, a lower surface and a hollow interior portion that are integrally formed as part of a unitary, one-piece construction during the blow-molding process;

a frame connected to the lower surface of the table top, the frame including at least one rail and at least one cross member;

one or more legs connected to the frame;

a downwardly extending lip disposed about an outer perimeter of the table top, the lip being integrally formed with the table top as part of the unitary, one-piece construction, the lip comprising:

a generally circular outer wall that is generally aligned with an outer surface of the table top;

a generally circular inner wall that is disposed towards an inner portion of the table top;

a lower wall that is spaced apart from the lower surface of the table top by a distance; and a hollow interior portion that is disposed between the outer wall and the inner wall of the lip; and a receiving portion integrally formed in the inner wall of the lip and extending towards the outer wall of the lip as part of the unitary, one-piece construction, the receiving portion comprising:

an upper surface;

a first sidewall formed by a portion of the inner wall of the lip extending towards the outer wall of the lip; and a compression portion with a substantially solid construction where the inner wall of the lip contacts and abuts the outer wall of the lip;

wherein a first end of the rail and a first end of the cross member are disposed in the receiving portion and are at least partially disposed within an envelope formed by the upper surface, the first sidewall and the compression portion of the receiving portion;

wherein the upper surface of the receiving portion is generally aligned with the lower surface of the table top;

wherein the receiving portion is disposed between the generally circular inner wall of the lip and the generally circular outer wall of the lip;

wherein the receiving portion allows the one or more legs to be positioned proximate the outer perimeter of the table top; and wherein the receiving portion allows a portion of the frame to be disposed proximate the outer perimeter of the table top.

2. The table as in claim 1, wherein the compression portion of the receiving portion comprises an inner surface of the inner wall of the lip contacting and abutting an inner surface of the outer wall of the lip.

3. The table as in claim 1, further comprising at least one depression disposed in the upper surface of the receiving portion.

4. The table as in claim 1, further comprising a plurality of depressions disposed in the upper surface of the receiving portion and the lower surface of the table top, at least one of the depressions disposed in the upper surface of the receiving portion being aligned with at least two or more depressions in the lower surface of the table top.

5. The table as in claim 1, wherein the first end of the rail disposed in the receiving portion is disposed at least proximate and directly adjacent the compression portion of the receiving portion; and wherein the first end of the cross member disposed in the receiving portion is disposed at least proximate and directly adjacent the compression portion of the receiving portion.

6. The table as in claim 1, wherein the outer wall of the lip has a generally circular configuration and the inner wall of the lip has a generally circular configuration.

7. The table as in claim 1, wherein the compression portion has a thickness generally equal to a thickness of the outer wall of the lip added to a thickness of the inner wall of the lip.

8. The table as in claim 1, wherein the inner wall of the lip and the outer wall of the lip are sandwiched together to form the compression portion.

9. The table as in claim 1, wherein the receiving portion further comprises a second sidewall formed by a portion of the inner wall of the lip extending towards the outer wall of the lip; and wherein the envelope is defined by the upper surface, the first sidewall, the second sidewall and the compression portion of the receiving portion.

10. The table as in claim 1, wherein the compression portion has a height measured from a lower portion of the lip that is at least two times a width of the compression portion.

11. A table comprising:

a table top constructed from blow-molded plastic;

a downwardly extending lip integrally formed with the table top as part of a unitary, one-piece construction, the lip including a thickness measured between an inner surface and an outer surface of the lip;

a receiving portion inwardly extending into the inner surface of the lip, the receiving portion having a thickness generally less than fifty percent of an average thickness of the lip;

a compression portion forming a portion of the receiving portion, the compression portion comprising the inner surface of the lip contacting the outer surface of the lip and having a substantially solid construction;

a frame including a portion that is disposed in the receiving portion to allow the portion of the frame to be disposed proximate an outer perimeter of the table top; and a leg assembly including a portion that is disposed in the receiving portion to allow a portion of the leg assembly to be disposed proximate the outer perimeter of the table top.

12. The table as in claim 11, wherein the table top, the lip, the receiving portion and the compression portion are integrally formed during the blow-molding process as part of the unitary, one-piece construction.

13. The table as in claim 11, wherein the thickness of the receiving portion is generally less than thirty percent of the average thickness of the lip.

14. The table as in claim 11, wherein the thickness of the receiving portion is generally less than twenty percent of the average thickness of the lip.

15. The table as in claim 11, further comprising a thicker portion disposed directly adjacent to the receiving portion, the thicker portion extending outwardly from the inner surface of the lip, the thicker portion having a thickness greater than the average thickness of the lip.

16. The table as in claim 11, further comprising an engagement surface of the portion of the frame that is disposed in the receiving portion, the engagement surface disposed at least directly adjacent the compression portion.

17. The table as in claim 11, further comprising an engagement surface of the portion of the leg assembly that is disposed in the receiving portion, the engagement surface disposed at least directly adjacent the compression portion.

18. A table comprising:

a table top;

a lip generally downwardly extending from the table top, the lip including an inner surface and an outer surface;

a receiving portion inwardly extending into the inner surface of the lip, the receiving portion including a compression portion where the inner surface of the lip contacts the outer surface of the lip, the receiving portion having a thickness less than fifty percent of an average thickness of the lip; and a frame including an end that is disposed in the receiving portion, the end of the frame being disposed at least proximate and directly adjacent the compression portion of the receiving portion;

wherein the receiving portion allows a portion of the frame to be disposed proximate an outer perimeter of the table top.

19. The table as in claim 18, wherein the thickness of the receiving portion is generally less than thirty percent of the average thickness of the lip.

20. The table as in claim 18, wherein the thickness of the receiving portion is generally less than twenty percent of the average thickness of the lip.

21. A table comprising:

a table top;

a lip generally downwardly extending from the table top, the lip including an inner surface and an outer surface;

a receiving portion inwardly extending into the inner surface of the lip, the receiving portion including a compression portion where the inner surface of the lip contacts the outer surface of the lip, the receiving portion having a thickness less than fifty percent of an average thickness of the lip; and a leg assembly including an end that is disposed in the receiving portion, the end of the leg assembly being disposed at least proximate and directly adjacent the compression portion of the receiving portion;

wherein the receiving portion allows a portion of the leg assembly to be disposed proximate the outer perimeter of the table top.

22. The table as in claim 21, wherein the thickness of the receiving portion is generally less than thirty percent of the average thickness of the lip.

23. The table as in claim 21, wherein the thickness of the receiving portion is generally less than twenty percent of the average thickness of the lip.

* * * * *

UNITED STATES PATENT AND TRADEMARK OFFICE

CERTIFICATE OF CORRECTION

PATENT NO. : 8,261,676 B2
APPLICATION NO. : 12/110163
DATED : September 11, 2012
INVENTOR(S) : Ed VanNimwegen et al.

It is certified that error appears in the above-identified patent and that said Letters Patent is hereby corrected as shown below:

1. In Column 4, Line 12, delete “blow molding” and insert -- blow-molding --, therefor.

2. In Column 5, Line 24, delete “a a” and insert -- a --, therefor.

Signed and Sealed this
Twenty-fifth Day of December, 2012

David J. Kappos

David J. Kappos
*Director of the United States Patent and Trademark Office*